US005316087A

United States Patent [19]

Manke et al.

[11] Patent Number: 5,316,087

[45] Date of Patent: May 31, 1994

[54] PYROTECHNIC CHARGE POWERED OPERATING SYSTEM FOR DOWNHOLE TOOLS

[75] Inventors: Kevin R. Manke, Flower Mound; David S. Wesson, Waxahachie; Roger L. Schultz, Richardson, all of Tex.

[73] Assignee: Halliburton Company, Houston, Tex.

[21] Appl. No.: 928,929

[22] Filed: Aug. 11, 1992

[51] Int. Cl.[5] ..... E21B 23/04

[52] U.S. Cl. ..... 166/381; 166/63

[58] Field of Search ..... 166/381, 63, 374, 319, 166/321, 332

[56] References Cited

U.S. PATENT DOCUMENTS

| | | | |
|---|---|---|---|
| 3,186,485 | 6/1965 | Owen | 166/63 |
| 3,217,804 | 11/1965 | Peter | 166/63 X |
| 3,233,674 | 2/1966 | Leutwyler | 166/63 |
| 3,298,437 | 1/1967 | Conrad | 166/63 |
| 5,062,485 | 11/1991 | Wesser et al. | 166/63 X |
| 5,211,224 | 5/1993 | Bouldin | 166/63 |

*Primary Examiner*—William P. Neuder

*Attorney, Agent, or Firm*—Tracy W. Druce; Lucian Wayne Beavers

[57] ABSTRACT

A downhole tool apparatus for use in a well includes a housing having a cylindrical chamber defined therein. A power piston is slidably disposed in the cylindrical chamber and divides the cylindrical chamber into first and second chamber portions on opposite sides of the power piston. First and second explosive charges are contained within the housing and communicated with the first and second chamber portions on opposite sides of the power piston. Firing of the first explosive charge moves the power piston in a first direction. Firing of the second explosive charge moves the power piston back in a second direction opposite the first direction. Thus, the operating power for a downhole tool is provided by selective firing of explosive charges which provide the operating pressure to move the power piston of the tool.

36 Claims, 5 Drawing Sheets

PYROTECHNIC CHARGE POWERED OPERATING SYSTEM FOR DOWNHOLE TOOLS

BACKGROUND OF THE INVENTION

1. Field of the Invention

The present invention relates generally to a system for actuating downhole tools by firing an explosive charge to generate an operating pressure.

2. Description of the Prior Art

The basic function of most downhole tools involves surface manipulation of a downhole operating system to accomplish a task such as opening a valve, for example, the opening and closing of a tester valve or circulation valve.

This process usually involves a linear actuator, i.e., a power piston, which works off a differential pressure acting across a hydraulic area.

There are several ways in which this pressure differential can be achieved to operate such a linear actuator.

One technique is the use of a nitrogen-charged system in which the nitrogen acts as a spring which supports hydrostatic well annulus pressure, but which can be further compressed with applied pressure at the surface allowing linear actuation across a hydraulic area down hole. An example of such a tool is seen in U.S. Pat. No. 4,711,305 to Ringgenberg.

Yet another system provides first and second pressure-conducting passages from either side of the power piston to the well annulus. A metering orifice type of retarding means is disposed in the second pressure-conducting passage for providing a time delay in communication of changes in well annulus pressure to the second side of the power piston. Accordingly, a rapid increase or rapid decrease in well annulus pressure causes a temporary pressure differential across the piston which moves the piston. An example of such a system is seen in U.S. Pat. No. 4,422,506 to Beck.

Still another approach is to provide both high and low pressure sources within the tool itself by providing a pressurized hydraulic fluid supply and an essentially atmospheric dump chamber. Such an approach is seen in U.S. Pat. No. 4,375,239 to Barrington et al.

Another approach is to utilize the well annulus pressure as a high pressure source, and to provide an essentially atmospheric pressure dump chamber as the low pressure zone within the tool itself. Such an approach is seen in U.S. Pat. Nos. 4,796,699; 4,856,595; 4,915,168; and 4,896,722, all to Upchurch.

The prior art also includes various downhole devices which utilize explosive charges. Explosive charges have not, however, been utilized to power a reciprocating linear actuator type of operating system of a downhole testing tool.

SUMMARY OF THE INVENTION

A downhole tool apparatus for use in a well includes a housing having a cylindrical chamber defined therein. A power piston is slidably disposed in the cylindrical chamber and divides the cylindrical chamber into first and second chamber portions on opposite sides of the power piston.

A first explosive charge means is communicated with the first chamber portion for moving the power piston in a first direction. A second explosive charge means is communicated with the second chamber portion for moving the power piston in a second direction opposite the first direction.

An initiating means is provided for initiating the first and second explosive charges. This is preferably accomplished in response to a command signal introduced into the well from a remote location.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS THE BACKGROUND ENVIRONMENT OF THE INVENTION

It is appropriate at this point to provide a description of the environment in which the present invention is used. During the course of drilling an oil well, the borehole is filled with a fluid known as drilling fluid or drilling mud. One of the purposes of this drilling fluid is to contain in intersected formations any formation fluid which may be found there. To contain these formation fluids the drilling mud is weighted with various additives so that the hydrostatic pressure of the mud at the formation depth is sufficient to maintain the formation fluid within the formation without allowing it to escape into the borehole. Drilling fluids and formation fluids can all be generally referred to as well fluids.

When it is desired to test the production capabilities of the formation, a testing string is lowered into the borehole to the formation depth and the formation fluid is allowed to flow into the string in a controlled testing program.

Sometimes, lower pressure is maintained in the interior of the testing string as it is lowered into the borehole. This is usually done by keeping a formation tester valve in the closed position near the lower end of the testing string. When the testing depth is reached, a packer is set to seal the borehole, thus closing the formation from the hydrostatic pressure of the drilling fluid in the well annulus. The formation tester valve at the lower end of the testing string is then opened and the formation fluid, free from the restraining pressure of the drilling fluid, can flow into the interior of the testing string.

At other times the conditions are such that it is desirable to fill the testing string above the formation tester valve with liquid as the testing string is lowered into the well. This may be for the purpose of equalizing the hydrostatic pressure head across the walls of the test string to prevent inward collapse of the pipe and/or may be for the purpose of permitting pressure testing of the test string as it is lowered into the well.

The well testing program includes intervals of formation flow and intervals when the formation is closed in. Pressure recordings are taken throughout the program for later analysis to determine the production capability of the formation. If desired, a sample of the formation fluid may be caught in a suitable sample chamber.

At the end of the well testing program, a circulation valve in the test string is opened, formation fluid in the testing string is circulated out, the packer is released, and the testing string is withdrawn.

Figure 1:
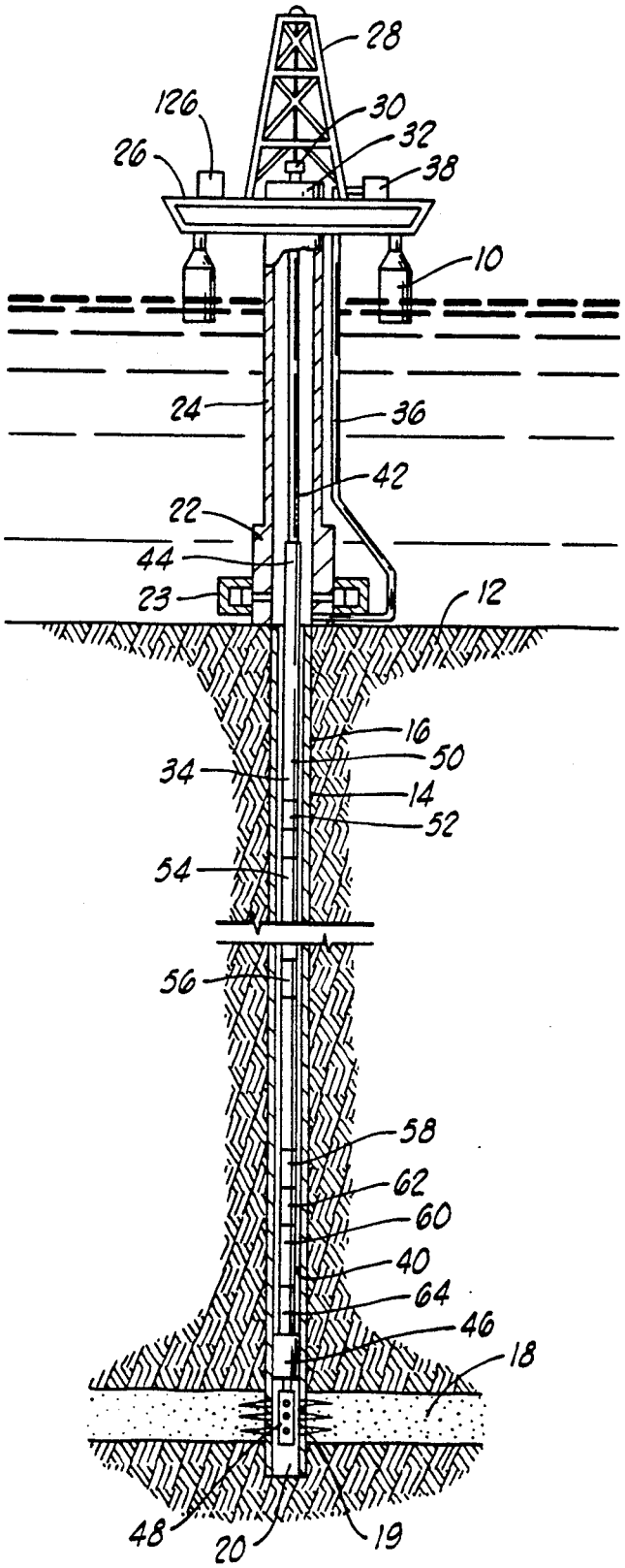
FIG. 1 is an elevation schematic view of a typical well test string in which the present invention may be incorporated.

A typical arrangement for conducting a drill stem test offshore is shown in FIG. 1. Of course, the present invention may also be used on wells located onshore.

The arrangement of the offshore system includes a floating work station 10 stationed over a submerged work site 12. The well comprises a well bore 14, which typically is lined with a casing string 16 extending from the work site 12 to a submerged formation 18. It will be appreciated, however, that the downhole tools described herein can also be used to test a well which has not yet had the casing set therein.

The casing string includes a plurality of perforations 19 at its lower end which provide communication between the formation 18 and a lower interior zone or annulus 20 of the well bore 14.

At the submerged well site 12 is located the well head installation 22 which includes blowout preventer mechanisms 23. A marine conductor 24 extends from the well head installation 22 to the floating work station 10. The floating work station 10 includes a work deck 26 which supports a derrick 28. The derrick 28 supports a hoisting means 30. A well head closure 32 is provided at the upper end of the marine conductor 24. The well head closure 32 allows for lowering into the marine conductor and into the well bore 14 a formation testing string 34 which is raised and lowered in the well by the hoisting means 30. The testing string 34 may also generally be referred to as a tubing string 34.

A supply conduit 36 is provided which extends from a hydraulic pump 38 on the deck 26 of the floating station 10 and extends to the well head installation 22 at a point below the blowout preventer 23 to allow the pressurizing of the well annulus 40 defined between the testing string 34 and the well bore 14.

The testing string 34 includes an upper conduit string portion 42 extending from the work deck 26 to the well head installation 22. A subsea test tree 44 is located at the lower end of the upper conduit string 42 and is landed in the well head installation 22.

The lower portion of the formation testing string 34 extends from the test tree 44 to the formation 18. A packer mechanism 46 isolates the formation 18 from fluids in the well annulus 40. Thus, an interior or tubing string bore of the tubing string 34 is isolated from the upper well annulus 40 above packer 46. Also, the upper well annulus 40 above packer 46 is isolated from the lower zone 20 of the well which is often referred to as the rat hole 20.

A perforated tail piece 48 provided at the lower end of the testing string 34 allows fluid communication between the formation 18 and the interior of the tubular formation testing string 34.

The lower portion of the formation testing string 34 further includes intermediate conduit portion 50 and torque transmitting pressure and volume balanced slip joint means 52. An intermediate conduit portion 54 is provided for imparting packer setting weight to the packer mechanism 46 at the lower end of the string.

It is many times desirable to place near the lower end of the testing string 34 a circulation valve 56 which may be opened by rotation or reciprocation of the testing string or a combination of both or by dropping of a weighted bar in the interior of the testing string 34. Below circulating valve 56 there may be located a combination sampler valve section and reverse circulation valve 58.

Also near the lower end of the formation testing string 34 is located a formation tester valve 60. Immediately above the formation tester valve 60 there may be located a drill pipe tester valve 62.

A pressure recording device 64 is located below the formation tester valve 60. The pressure recording device 64 is preferably one which provides a full opening passageway through the center of the pressure recorder to provide a full opening passageway through the entire length of the formation testing string.

The present invention relates to a system for actuating various ones of the tools found in such a testing string 34, and relates to novel constructions of such tools designed for use with this new actuating system. Typical examples of the tools to which this new actuating system may be applied would be the formation tester valve 60 and/or the combination sampler section and reverse circulating valve 58.

The Present Invention

Figure 2:
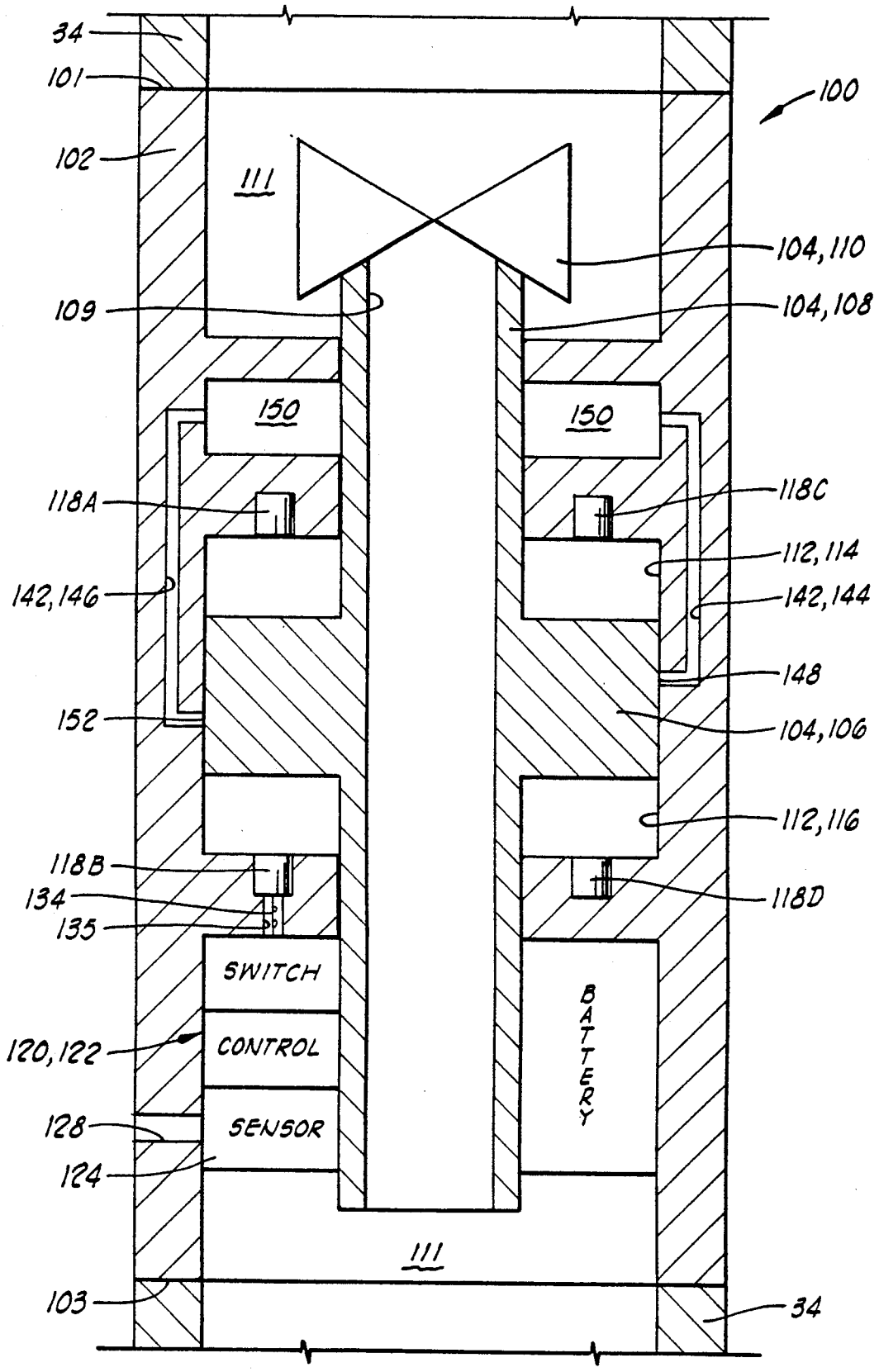
FIG. 2 is an elevation sectioned schematic view of a first embodiment of the invention utilizing electrically fired charges.

FIG. 2 is an elevation schematic sectioned view of a first embodiment of a downhole tool embodying the present invention. The tool shown in FIG. 2 is designated by the numeral 100 and as previously mentioned it could be utilized in place of the formation tester valve 60 or the sampler/circulating valve 58 of FIG. 1 The downhole tool 100 includes a housing 102 which is adapted at its upper and lower ends 101 and 103 to be connected into the testing string 34.

An operating assembly generally designated by the numeral 104 is disposed in housing 102. Operating assembly 104 includes a power piston 106, a power mandrel 108, and an operating element 110. The power mandrel 108 has a longitudinal mandrel bore 109 defined therethrough which is communicated with a central housing passageway 111 defined through housing 102. The central housing passageway 111 is communicated with the bore of tubing string 34 so that fluids flowing through the bore of tubing string 34 flow through the mandrel bore 109.

As further described below, the power piston 106 reciprocates up and down thus causing linear up and down movement of the power mandrel 108 to operate the operating element 110. The operating element 110 may be of many different varieties corresponding to the various tools within the testing string 34 illustrated in FIG. 1 and previously described.

For example, the operating element 110 may be a rotating ball valve type element of a formation tester valve 60 having an operating mechanism substantially like that shown in U.S. Pat. No. 3,856,085 to Holden et al., the details of which are incorporated herein by reference.

As another example, the operating element 110 could be a sliding sleeve valve of a reclosable reverse circulation valve 58 having an associated operating mechanism substantially like that shown in U.S. Pat. No. 4,113,012 to Evans et al., the details of which are incorporated herein by reference. Preferably, the indexing system of the Evans et al. tool would be deleted.

The operating element 110 may also be a closure element of any one of several types of known sampling apparatus.

Also, a multi-mode operating element could be used substantially like that shown in U.S. Pat. No. 4,711,305 to Ringgenberg, the details of which are incorporated herein by reference.

The housing 102 has a cylindrical power chamber 112 defined therein. The power piston 106 divides the power chamber 112 into upper and lower power chamber portions 114 and 116. The power chamber 112 can be said to be communicated with the power piston 106 of operating assembly 104 in that pressure changes within the power chamber 112 act upon the power piston 106.

Figure 3:
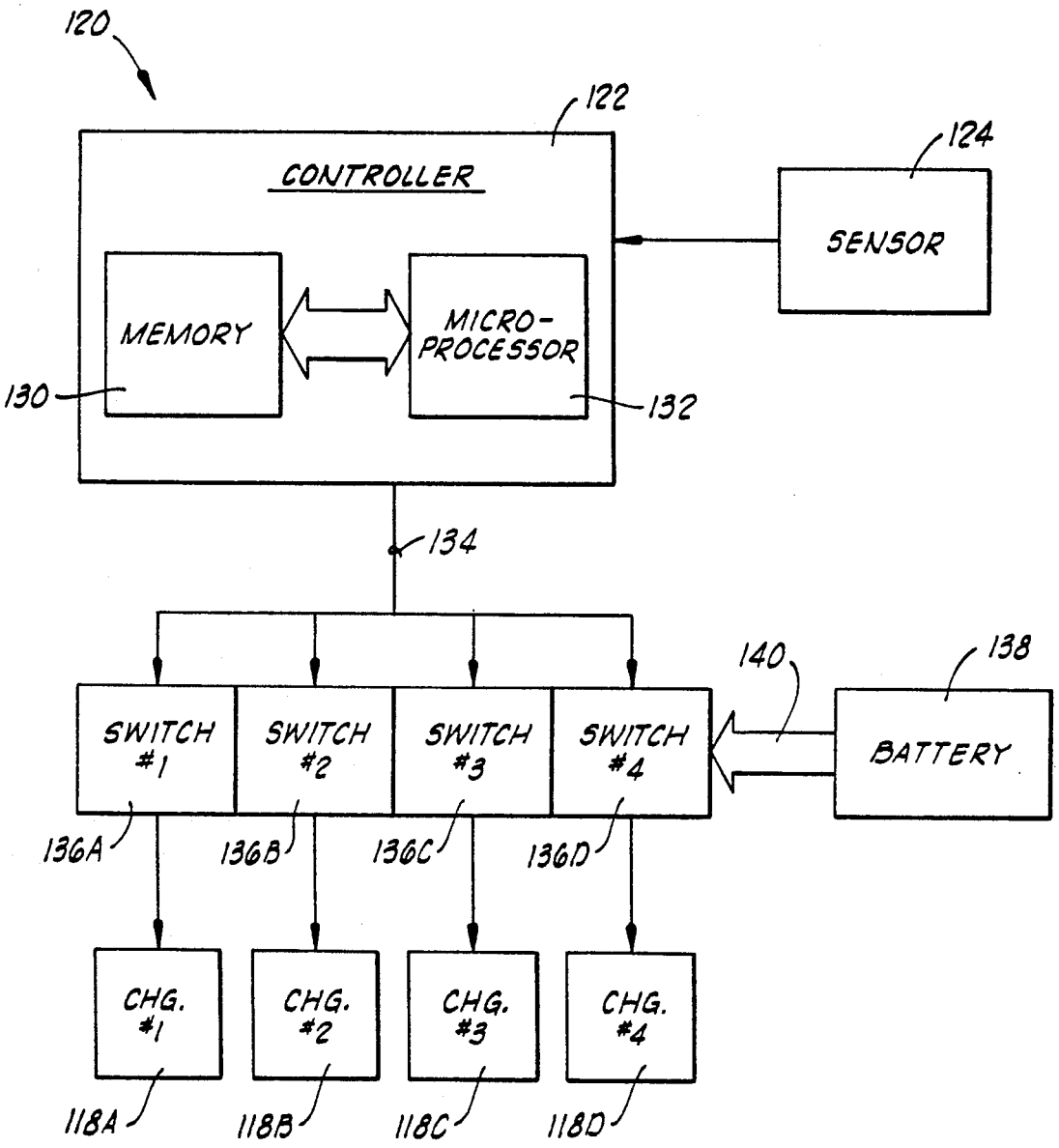
FIG. 3 is a schematic illustration of the electrical circuitry of the apparatus of FIG. 2.

A plurality of explosive charges are contained within the housing 102 and communicated with the upper and lower power chamber portions 114 and 116. In FIG. 2, four explosive charges are shown and designated by the numerals 118A, 118B, 118C and 118D The explosive charges 118 shown in FIGS. 2 and 3 are electrically fired explosive charges such as electrically fired blasting caps or the like. Alternatively instead of conventional blasting caps, a slow burning charge may be utilized. In either event, when one of the explosive charges 118 is fired, it generates high temperature, high pressure gases within its associated power chamber portion power piston 106 to move the power piston 106 within the power chamber 112.

For example, if the explosive charge 118A is first fired, it will create a high pressure within upper power chamber 114 thus driving the power piston 106 downward to move the operating element 110. For example, if the operating element 110 is a ball-type tester valve, it may be moved from a closed to an open position upon downward movement of the piston 106. When it is desired to reclose the valve element 110, the second explosive charge 118B will be fired thus driving the power piston 106 back upward. The power piston 106 can be further reciprocated by subsequent sequential firing of third charge 118C and fourth charge 118D. It will be apparent that any number of charges can be provided on either side of the power piston 106 to provide the desired number of operating cycles of the downhole tool 100.

The tool 100 includes an initiating means generally designated by the numeral 120. The initiating means is best described with regard to the schematic illustration of FIG. 3. The initiating means 100 provides a means for initiating or triggering the various explosive charges 118 at selected times.

In the embodiment illustrated in FIGS. 2 and 3, the explosive charges 118 are electrically fired explosive charges. In this embodiment, the initiating means 120 includes a controller or control means 122 for generating electrical control signals. Initiating means 120 further includes a sensor means 124 for sensing one or more command signals introduced into the well bore 14 from a location remote from tool 100, such as from a remote control station 126 (see FIG. 1) located upon the floating work station 10.

As seen in FIG. 2, the sensor 124 may be communicated with the well annulus 40 through a port 128. The sensor 124 senses command signals introduced into the well bore from remote command station 126. For example, the sensor 124 may be an acoustic sensor and the command station 126 may introduce encoded acoustic signals into the fluid contained in well annulus 40. The sensor 124 could also be a pressure sensor which senses increases in the fluid pressure of the annulus fluid contained in the well annulus 40. Other types of remote command systems and sensors are described below in the section entitled "Techniques For Remote Control".

The controller 122 preferably is a microprocessor-based controller which includes a memory section 130 and a microprocessor 132 with other related input and output circuitry to interconnect the microprocessor to the sensor 124 and to the various outputs.

The controller 122 generates electrical control signals which are communicated over output bus 134 to a series of switches 136A, 136B, 136C and 136D.

It will be understood that the output bus 134 will include a plurality of electrical connectors routed through various passages in housing 102 and connected to each of the charges 118. In FIG. 2, only a small portion of output bus 134 is shown in place within a passage 135 communicated with the second charge 118B.

The initiating means 120 further includes an electrical power source such as battery 138. The power source 138 is connected to switches 136 by power bus 140.

The switches act in response to the command signals from controller 122 to selectively communicate power from battery 138 to the chosen one of the electrically fired charges 118. For example, when it is desired to fire the first charge 118A to move the power piston 106 downward, the appropriate command signal is introduced from command station 126 into the well annulus and is sensed by sensor 124. In response to that command signal, controller 122 generates a control signal which causes switch 136A to close thus communicating power from battery 138 to the electrically fired charge 118A thus firing charge 118A and creating high pressure within the upper power chamber portion 114 thus driving power piston 106 downward.

When it is desired to move power piston 106 back upward, another appropriate command signal is given and charge 118B is fired thus driving the power piston 106 back upward.

The microprocessor-based controller 122 may also be self-contained and utilize an internal timer with preprogrammed operating sequences for firing of the various charges 118 at preselected times. Further, the controller 122 can be programmed to monitor a well parameter such as downhole pressure through means of the sensor 124 and to actuate the selected charges in some preprogrammed manner in response to that monitored downhole parameter.

It is also contemplated that depending upon the particular design of the explosive charge actuating system, it may be desired to provide a vent means 142 for venting high pressure gases from the power chamber 112 after the power piston 106 is moved to perform each of the operating movements of operating element 110. In the embodiment shown in FIG. 2, the vent means includes a pair of vent passages 144 and 146 which are operably associated with the upper and lower power chamber portions 114 and 116, respectively. For example, after the first charge 118A fires and the hot expanding gases begin to drive the power piston 106 downward, the downward movement of power piston 106 will eventually uncover a port 148 of an upper vent passage 144 thus communicating the upper power chamber portion 104 with a dump chamber 150 defined within the housing 102. The dump chamber 150 may be described as a low pressure dump chamber which preferably initially contains only air at atmospheric pressure.

Similarly, when the second explosive charge 118B is fired to drive the power piston 106 back upward, the power piston 106 will eventually uncover a port 152 of lower vent passage 146 which will communicate the lower power chamber portion 116 with dump chamber 150.

It will be appreciated that as this process continues, the pressure contained within dump chamber 150 will gradually rise. Thus the dimensions of dump chamber 150 must be designed to accommodate the desired number of operating strokes of the tool 100.

Figure 4:
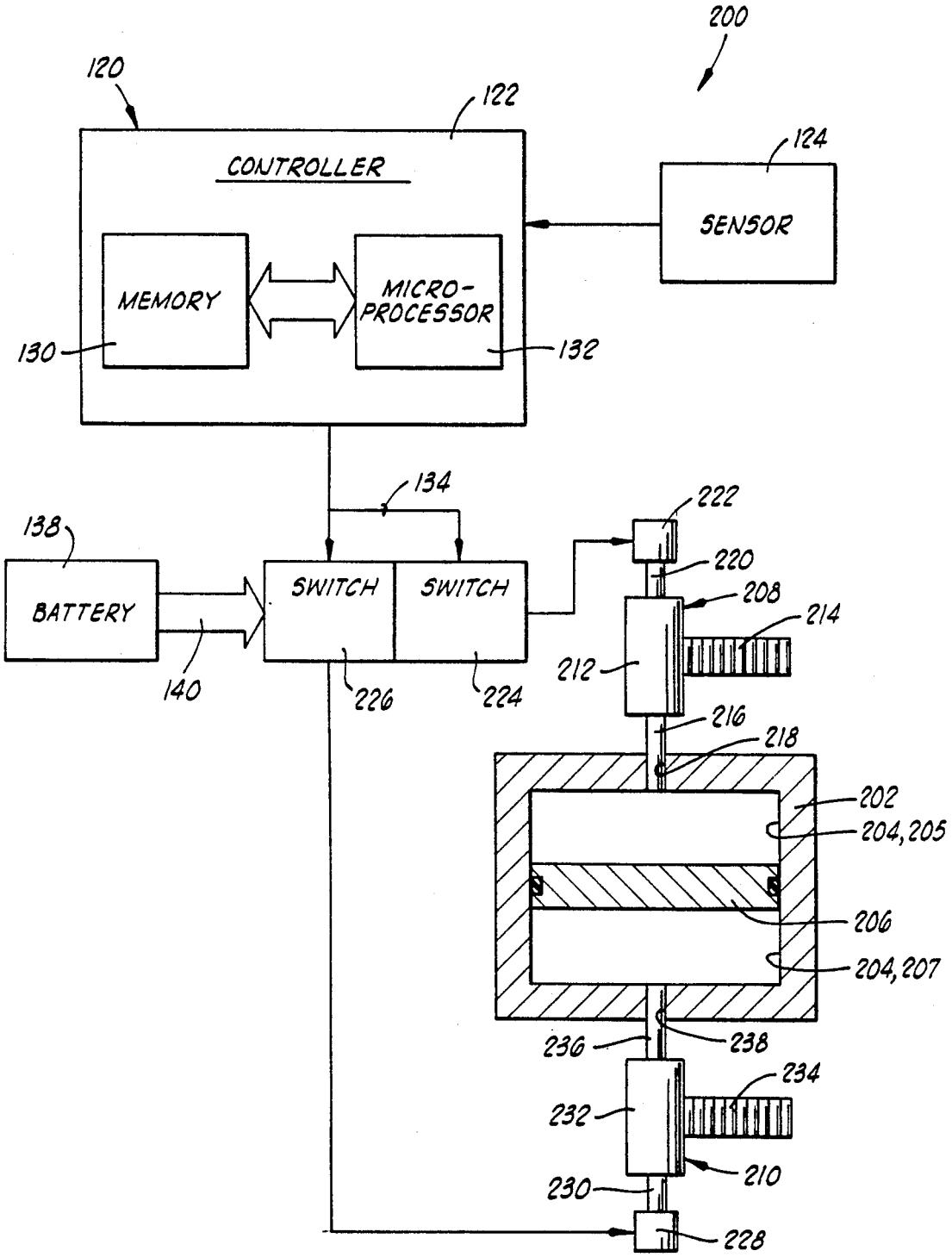
FIG. 4 is a schematic illustration of a second embodiment of the invention utilizing percussion fired charges actuated by an electronic control system.

The Embodiment Of FIG. 4

In FIG. 4, a second embodiment of the invention is shown and generally designated by the numeral 200. Again the tool 200 may be any of the various tools of testing string 34 previously described, and particularly it may be a tester valve in position 60, or a sampler/circulating valve in position 58. The tool 100 includes a housing generally designated by the numeral 202. The housing 202 has a power chamber 204 defined therein within which a power piston 206 is reciprocably received.

For ease of illustration in FIG. 4, the housing 202, power chamber 204 and power piston 206 are only shown very schematically, but it will be understood that their actual construction is more like that shown in FIG. 2 wherein the power piston 206 is attached to a tubular power mandrel which actuates an operating element like the operating element 110 previously described.

The power chamber 204 has upper and lower power chamber portions 205 and 207.

In this embodiment, instead of utilizing separate electrically fired charges disposed in the housing like the charges 118 of FIGS. 2 and 3, a mechanical firing apparatus is provided for firing percussion-fired charges such as for example blank cartridges like those used in a rifle. For example, blank 22-caliber percussion-fired cartridges may be utilized.

There are two of these mechanical firing mechanisms designated by the numerals 208 and 210. These may be referred to as upper and lower mechanical firing mechanisms and as will be seen, they are associated with the upper and lower power chamber portions 205 and 207, respectively.

The upper mechanical firing mechanism 208 includes a firing assembly 212 which is constructed in a manner like that of a semi-automatic rifle. A clip 214 of blank 22-caliber cartridges feeds into the firing mechanism 212. A barrel 216 extends from firing mechanism 212 and communicates with a port 218 which leads to upper power chamber portion 205. When the assembly 212 fires one of the blank cartridges from clip 214, the high pressure gases created thereby are communicated through barrel 216 and port 218 to the upper power chamber portion 205.

The firing assembly 212 is triggered by reciprocation of a triggering shaft 220 which is operated by electric solenoid 222. The solenoid 222 is operated by controller 122 which will cause a switch 224 to communicate power from battery 138 to the solenoid 222 when it is desired to trigger the firing assembly 212.

Similarly, the lower mechanical firing mechanism 210 is actuated by closing switch 226 which provides power to a solenoid 228 which moves triggering shaft 230 to cause firing assembly 232 to fire a blank 22-caliber cartridge from clip 234. The explosive gases are communicated through barrel 236 and port 238 to the lower power chamber portion 207.

It is noted that in FIG. 4, no vent means is shown in connection with the power chamber 204. Depending upon the construction of the explosive charge powered operating system, it may not be necessary to utilize a vent system. Depending upon the construction of the explosive charges, and the time between use of charges, some systems will be operable without the need for a vent system. The high temperature, high pressure gases will significantly reduce in pressure upon cooling shortly after the explosion has occurred. Also, since alternating explosions will occur on opposite sides of the power piston 206, the pressure within each of the upper and lower power chambers 205 and 207 will increase with successive explosions but the pressure differential therebetween will not greatly change over time. Thus, so long as the housing 202 is constructed so as to contain the pressures, the system will still operate without a vent system.

Figure 5:
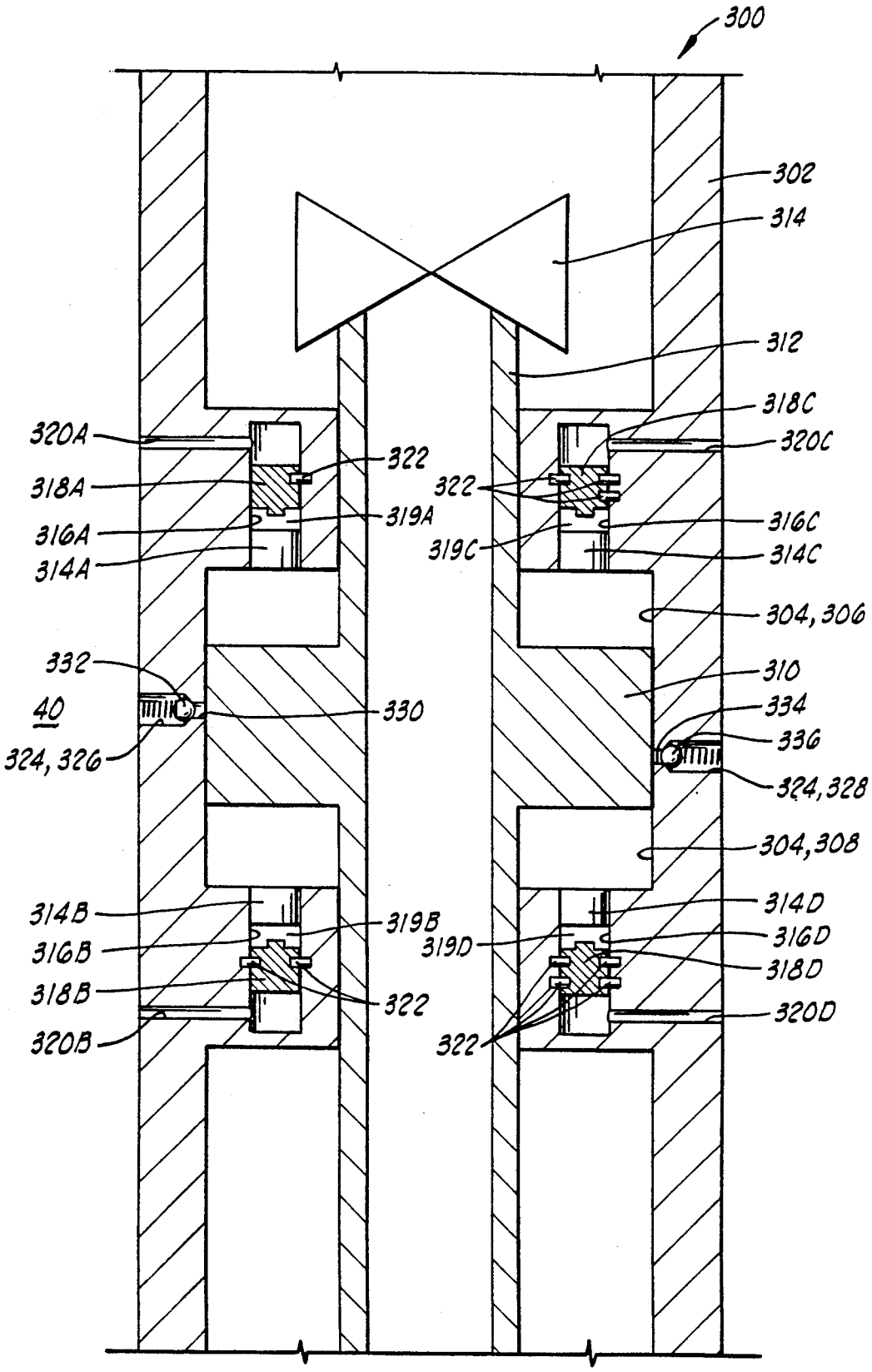
FIG. 5 is a schematic illustration of a third embodiment of the invention which uses percussion fired charges actuated by a hydraulic/mechanical control system.

The Embodiment Of FIG. 5

A third embodiment of the invention is shown in FIG. 5 and generally designated by the numeral 300.

The tool 300 is modified in that it includes a completely mechanical initiating system and it shows another alternative venting system.

The tool 300 includes a housing 302 having a power chamber 304 defined therein which is divided into upper and lower power chamber portions 306 and 308 by a power piston 310. Power piston 310 is connected to a power mandrel 312 which operates an operating element 314 as previously described in regard to FIG. 1.

The tool 300 includes first, second, third and fourth percussion-fired explosive charges 314A, 314B, 314C and 314D. These percussion-fired charges may for example be blank 22-caliber cartridges.

Each of the charges 314 is received in an associated one of a plurality of radially offset bores 316A, 316B, 316C and 316D defined in housing 302. Contained in each of the bores 316 is one of a plurality of firing pistons 318A, 318B, 318C and 318D. Spaces such as 319A, 319B, 319C and 319D between pistons 318 and charges 314 preferably contain atmospheric pressure.

Each of the radially offset bores 316 is communicated with the well annulus 40 surrounding tool 300 through a power port 320A, 320B, 320C, or 320D.

Each of the firing pistons 318 is frangibly held in place relative to the housing 302 by one or more shear pins. The shear pins are constructed so that each of the firing pistons will actuate at a different external pressure. For example, piston 318A is held in place by a single shear pin 322, piston 318B is held in place by two shear pins 322, piston 318C is held in place by three shear pins 322, and piston 318D is held in place by four shear pins 322. Thus the firing pistons 316A, 316B, 316C, and 316D will each operate at successively higher external pressures.

The apparatus 300 is operated by increasing well pressure in the annulus 40 to a predetermined level determined by the design of the shear pins 322. At a first level, the first firing piston 318A will be released and will impact the first percussion-fired cartridge 314A to drive the power piston 310 downward.

When the external pressure is increased to a second level, the second firing piston 318B will be released, and so forth.

The tool 300 of FIG. 5 also illustrates another alternative vent means designated by the numeral 324. The vent means 324 includes upper and lower vents 326 and 328.

The upper vent 326 includes an upper vent passage 330. When the power piston 310 moves downward a sufficient amount, the upper power chamber portion 306 will be communicated through the upper vent passage 330 with the well bore 40 exterior of the tool 300. A spring-biased check valve 332 is disposed in passage 330 to prevent flow of external well fluid therethrough.

Similarly, the lower vent 328 includes a lower vent passage 334 having a spring-loaded check valve 336 disposed therein.

The Various Vent Systems Are Usable On Any Of The Three Embodiments

The embodiments 100, 200 and 300 seen in FIGS. 2, 4 and 5, respectively, have each illustrated both a different form of the explosive charge powered actuating system and a different means for either venting or accommodating the pressures created within the power chamber. It will be appreciated that each of the vent systems, namely the dump chamber vent system of FIG. 2, the non-vent system of FIG. 4, and the well annulus vent system of FIG. 5 can be utilized with any one of the embodiments of the operating system seen in FIGS. 2, 4 or 5.

Techniques For Remote Control

Many different systems can be utilized to send command signals from the remote surface location 126 down to the sensor 124 to control any of the tools 100, 200 or 300.

One suitable system is the signaling of the control package 122, and receipt of feedback from the control package 122, using acoustical communication which may include variations of signal frequencies, specific frequencies, or codes of acoustical signals or combinations of these. The possible acoustical transmission media includes tubing string, casing string, electric line, slick line, subterranean soil around the well, tubing fluid, and annulus fluid. An example of a system for sending acoustical signals down the tubing string is seen in U.S. Pat. Nos. 4,375,239; 4,347,900; and 4,378,850 all to Barrington and assigned to the assignee of the present invention.

A second suitable remote control system is the use of a mechanical or electronic pressure activated control package 122 which responds to pressure amplitudes, frequencies, codes or combinations of these which may be transmitted through tubing fluid, casing fluid, fluid inside coiled tubing which may be transmitted inside or outside the tubing string, and annulus fluid.

A third remote control system which may be utilized is radio transmission from the surface location or from a subsurface location, with corresponding radio feedback from the tool to the surface location or subsurface location.

A fourth possible remote control system is the use of microwave transmission and reception.

A fifth type of remote control system is the use of electronic communication through an electric line cable suspended from the surface to the downhole control package.

A sixth suitable remote control system is the use of fiberoptic communications through a fiberoptic cable suspended from the surface to the downhole control package.

A seventh possible remote control system is the use of acoustic signaling from a wire line suspended transmitter to the downhole control package with subsequent feedback from the control package to the wire line suspended transmitter/receiver. Communication may consist of frequencies, amplitudes, codes or variations or combinations of these parameters.

An eighth suitable remote communication system is the use of pulsed X-ray or pulsed neutron communication systems.

As a ninth alternative, communication can also be accomplished with the transformer coupled technique which involves wire line conveyance of a partial transformer to a downhole tool. Either the primary or secondary of the transformer is conveyed on a wire line with the other half of the transformer residing within the downhole tool. When the two portions of the transformer are mated, data can be interchanged.

All of the systems described above may utilize an electronic control package 122 that is microprocessor based.

It is also possible to utilize a preprogrammed microprocessor-based control package 122 which is completely self-contained and is programmed at the surface to provide a pattern of operation of the downhole tool which it controls. For example, a remote control signal from the surface could instruct the microprocessor-based electronic control package 122 to start one or more preprogrammed sequences of operations. Also, the preprogrammed sequence could be started in response to a sensed downhole parameter such as bottom hole pressure. Such a self-contained system may be constructed in a manner analogous to the self-contained downhole gauge system shown in U.S. Pat. No. 4,866,607 to Anderson et al., and assigned to the assignee of the present invention.

Thus, it is seen that the present invention readily achieves the ends and advantages mentioned as well as those inherent therein. While certain preferred embodiments of the invention have been described and illustrated for purposes of the present disclosure, numerous changes may be made by those skilled in the art which changes are encompassed within the scope and spirit of the present invention as defined by the appended claims.

What is claimed is:

1. A downhole tool apparatus for use in a well, comprising:

a housing;

an operating assembly disposed in said housing;

a power chamber defined in said housing and communicated with said operating assembly;

a first explosive charge means communicated with said power chamber for creating a first operating pressure communicated to said operating assembly through said power chamber to move said operating assembly from a first position to a second position; and a second explosive charge means communicated with said power chamber for creating a second operating pressure communicated to said operating assembly through said power chamber to move said operating assembly from its second position.

2. The apparatus of claim 1, wherein:

said operating assembly includes a power piston slidably disposed in said power chamber and dividing said power chamber into a first power chamber portion and a second power chamber portion;

said first explosive charge means is communicated with said first power chamber portion; and said second explosive charge means is communicated with said second power chamber portion.

3. The apparatus of claim 1, further comprising:

initiating means for initiating said first explosive charge means at a first selected time and for then initiating said second explosive charge means a second selected time.

4. The apparatus of claim 3, wherein:

said first and second explosive charge means are first and second electrically fired explosive charge means; and said initiating means includes:

a control means for generating electrical control signals;

an electrical power source; and switching means for connecting said electrical power source to said first and second electrically fired explosive charge means in response to said control signals.

5. The apparatus of claim 4, wherein:

said initiating means further includes sensor means for sensing one or more command signal introduced into said well from a location remote from said apparatus; and said control means is operably associated with said sensor means and is responsive to said command signals so that said control means is a means for generating said electrical control signals in response to said command signals.

6. The apparatus of claim 4, wherein said control means is a microprocessor-based control means.

7. The apparatus of claim 3, wherein said initiating means is a mechanically actuated initiating means.

8. The apparatus of claim 1, further comprising:

vent means for venting high pressure gases from said power chamber after said operating assembly is moved from its said first position, and for again venting high pressure gases from said power chamber after said operating assembly is moved from its said second position.

9. The apparatus of claim 8, wherein:

said housing has a low pressure dump chamber defined therein and communicated with said vent means so that said high pressure gases are vented to said dump chamber.

10. The apparatus of claim 8, wherein:

said vent means is a means for venting said high pressure gases into a well annulus surrounding said housing.

11. A downhole tool apparatus for use in a well, comprising:

a housing having a cylindrical chamber defined therein;

a power piston slidably disposed in said cylindrical chamber and dividing said cylindrical chamber into first and second chamber portions on opposite sides of said power piston;

a first explosive charge means communicated with said first chamber portion for moving said power piston in a first direction; and a second explosive charge means communicated with said second chamber portion for moving said power piston in a second direction opposite said first direction.

12. The apparatus of claim 11, further comprising:

a power mandrel disposed in said housing, said power piston being attached to said power mandrel for moving said power mandrel relative to said housing; and an operating element, operably associated with said power mandrel so that said operating element is moved between first and second positions thereof as said power piston moves back and forth within said cylindrical chamber.

13. The apparatus of claim 12, wherein:

said operating element is a ball type tester valve.

14. The apparatus of claim 12, wherein:

said operating element is a circulating valve.

15. The apparatus of claim 12, wherein:

said operating element is a closure element of a sampler.

16. The apparatus of claim 12, wherein:

said housing has a central housing passage defined longitudinally therethrough and said housing has first and second ends constructed to be connected to a tubing string so that said central housing passage communicates with a tubing string bore of said tubing string; and said power mandrel has a longitudinal mandrel bore defined therethrough and communicated with said central housing passage so that fluids flowing through said tubing string bore flow through said mandrel bore.

17. The apparatus of claim 16, further comprising:

initiating means for initiating said first and second explosive charge means.

18. The apparatus of claim 17, wherein:

said first and second explosive charge means are first and second electrically fired explosive charge means; and said initiating means includes:

a control means for generating electrical control signals;

an electrical power source; and switching means for connecting said electrical power source to said first and second electrically fired explosive charge means in response to said control signals.

19. The apparatus of claim 18, wherein:

said initiating means further includes sensor means for sensing one or more command signal introduced into said well from a location remote from said apparatus; and said control means is operably associated with said sensor means and is responsive to said command signals so that said control means is a means for generating said electrical control signals in response to said command signals.

20. The apparatus of claim 18, wherein said control means is a microprocessor-based control means.

21. The apparatus of claim 17, wherein said initiating means is a mechanically actuated initiating means.

22. The apparatus of claim 16, further comprising:

first vent means for venting high pressure gases from said first chamber portion after said first explosive charge means is fired; and second vent means for venting high pressure gases from said second chamber portion after said second explosive charge means is fired.

23. The apparatus of claim 22, wherein:

said housing has a low pressure dump chamber defined therein and communicated with said first and second vent means so that said high pressure gases are vented to said dump chamber.

24. The apparatus of claim 22, wherein:

said first and second vent means are means for venting said high pressure gases into a well annulus surrounding said housing.

25. A downhole tool apparatus for use in a well, comprising:

an operating assembly;

a plurality of explosive charges, operably associated with said operating assembly; and initiating means for initiating selected ones of said plurality of explosive charges in turn and for thereby causing a plurality of movements of said operating assembly.

26. The apparatus of claim 25, wherein:

said explosive charges are electrically actuated explosive charges; and said initiating means includes:

a control means for generating electrical control signals;

an electrical power source; and switching means for connecting said electrical power source to said electrically actuated explosive charges in response to said control signals.

27. The apparatus of claim 26, wherein:

said initiating means further includes sensor means for sensing one or more command signals introduced into said well from a location remote from said apparatus; and said control means is operably associated with said sensor means and is responsive to said command signals so that said control means is a means for generating said electrical control signals in response to said command signals.

28. The apparatus of claim 26, wherein said control means is a microprocessor-based control means.

29. The apparatus of claim 25, wherein:

said explosive charges are percussion fired explosive charges; and said initiating means is a mechanically actuated initiating means for firing said percussion fired explosive charges.

30. A method of powering an operating element of a downhole tool in a well, comprising:

(a) firing a first explosive charge and thereby moving said operating element from a first position to a second position; and (b) firing a second explosive charge and thereby moving said operating element from said second position.

31. The method of claim 30, wherein said operating element includes a reciprocable power piston, and in step (a) said piston is moved in a first direction, and in step (b) said piston is moved in a second direction opposite said first direction.

32. The method of claim 30, wherein said step (a) comprises:

(a)(1) generating an electrical control signal with a controller; and (a)(2) connecting an electrical power source to said first explosive charge in response to said control signal to fire said first explosive charge.

33. The method of claim 32, wherein said step (a) further comprises:

prior to step (a)(1), introducing a command signal into said well at a location remote from said tool;

sensing said command signal at said tool; and wherein said step (a)(1) is performed by said controller in response to said command signal.

34. The method of claim 30, further comprises:

after step (a), venting high pressure gases created by said first explosive charge; and after step (b), venting high pressure gases created by said second explosive charge.

35. The method of claim 34, wherein:

said venting steps include venting said high pressure gases to a low pressure dump chamber defined within said tool.

36. The method of claim 34, wherein:

said venting steps include venting said high pressure gases to a well annulus surrounding said tool.

* * * * *